US010751991B2

(12) United States Patent
Seki

(10) Patent No.: US 10,751,991 B2
(45) Date of Patent: Aug. 25, 2020

(54) INKJET HEAD AND INKJET PRINTER

(71) Applicant: TOSHIBA TEC KABUSHIKI KAISHA, Tokyo (JP)

(72) Inventor: Masashi Seki, Sunto Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/144,362

(22) Filed: Sep. 27, 2018

(65) Prior Publication Data

US 2019/0118532 A1 Apr. 25, 2019

(30) Foreign Application Priority Data

Oct. 25, 2017 (JP) ..... 2017-205868

(51) Int. Cl.

| | |
|---|---|
| ***B41J 2/045*** | (2006.01) |
| ***B41J 2/055*** | (2006.01) |
| ***B41J 2/165*** | (2006.01) |
| ***B41J 2/14*** | (2006.01) |
| ***B41J 2/16*** | (2006.01) |

(52) U.S. Cl.

CPC ..... *B41J 2/04581* (2013.01); *B41J 2/055* (2013.01); *B41J 2/14201* (2013.01); *B41J 2/1606* (2013.01); *B41J 2/1609* (2013.01); *B41J 2/1623* (2013.01); *B41J 2/16538* (2013.01); *B41J 2002/16502* (2013.01)

(58) Field of Classification Search

CPC .... B41J 2/165; B41J 2/16505; B41J 2/04581; B41J 2/16511; B41J 2/16523; B41J 2/055; B41J 2/1606; B41J 2/16538

See application file for complete search history.

(56) References Cited

U.S. PATENT DOCUMENTS

| | | | | |
|---|---|---|---|---|
| 5,646,657 | A * | 7/1997 | Aoki | B41J 2/1606 347/45 |
| 6,296,946 | B1 | 10/2001 | Kotera et al. | |
| 7,267,426 | B2 | 9/2007 | Miyajima et al. | |
| 8,506,051 | B2 | 8/2013 | Gulvin et al. | |
| 2004/0125169 | A1* | 7/2004 | Nakagawa | B05D 5/083 347/45 |

(Continued)

FOREIGN PATENT DOCUMENTS

| | | |
|---|---|---|
| CN | 1550337 A | 12/2004 |
| CN | 1915670 A | 2/2007 |

(Continued)

OTHER PUBLICATIONS

U.S. Appl. No. 16/130,351, filed Sep. 13, 2018.

(Continued)

*Primary Examiner* — Kristal Feggins
(74) *Attorney, Agent, or Firm* — Kim & Stewart LLP

(57) ABSTRACT

An inkjet head includes a nozzle plate substrate having a nozzle for ejecting ink toward a recording medium, and an oil repellent layer on a surface of the nozzle plate substrate, the surface facing the recording medium. The oil repellent layer comprises a fluorine-based compound in which neighboring molecules are cross-linked in a direction parallel to the surface, and cross-links of the neighboring molecules are resistant to structural change when subjected to rubbing by an ink wiping blade.

18 Claims, 8 Drawing Sheets

(56) References Cited

U.S. PATENT DOCUMENTS

| | | | | |
|---|---|---|---|---|
| 2005/0088485 | A1* | 4/2005 | Tamahashi | B41J 2/1433 347/45 |
| 2007/0247492 | A1* | 10/2007 | Mori | B41J 2/1433 347/45 |
| 2012/0098889 | A1 | 4/2012 | Arakawa | |

FOREIGN PATENT DOCUMENTS

| | | | |
|---|---|---|---|
| CN | 102180015 | A | 9/2011 |
| CN | 102555326 | A | 7/2012 |
| CN | 105623418 | A | 6/2016 |
| JP | 2007106024 | A | 4/2007 |

OTHER PUBLICATIONS

U.S. Appl. No. 16/130,300, filed Sep. 13, 2018.
U.S. Appl. No. 16/130,366, filed Sep. 13, 2018.
Chinese Office Action dated Jun. 18, 2020, mailed in counterpart Chinese Application No. 201811228019.6, 25 pages (with translation).

* cited by examiner

INKJET HEAD AND INKJET PRINTER

CROSS-REFERENCE TO RELATED APPLICATIONS

This application is based upon and claims the benefit of priority from Japanese Patent Application No. 2017-205868, filed Oct. 25, 2017, the entire contents of which are incorporated herein by reference.

FIELD

Embodiments described herein relate to an inkjet head and an inkjet printer.

BACKGROUND

In an inkjet head, ink is pressurized by a piezoelectric element and ink droplets are ejected from nozzles in a nozzle plate. Ink repellent layer or an oil repellent layer is added to the surface of the nozzle plate so that ink does not adhere to the surface. An oil repellent layer is formed by, for example, depositing a fluorine-based compound on the surface of the nozzle plate substrate by a coating method or a vapor phase deposition.

In addition to the oil repellant layer, a wiping blade may be added to remove ink on that surface of the nozzle plate that faces a recording medium so that the inkjet head is cleaned. However, the ink repellency of the nozzle plate surface may deteriorate due to cleaning with the wiping blade.

DETAILED DESCRIPTION

In general, according to one embodiment, an inkjet head includes a nozzle plate substrate having a nozzle for ejecting ink toward a recording medium, and an oil repellent layer on a surface of the nozzle plate substrate, the surface facing the recording medium. The oil repellent layer comprises a fluorine-based compound in which neighboring molecules are cross-linked in a direction parallel to the surface, and cross-links of the neighboring molecules are resistant to structural change when subjected to rubbing by an ink wiping blade.

Some oil repellent layers contain a fluorine-based compound cross-linked between neighboring molecules in the direction parallel to the surface of the nozzle plate substrate that faces the recording medium, and have a structure in which the surface bonding state is not altered by rubbing.

Some other oil repellent layers contain a fluorine-based compound cross-linked between neighboring molecules in a direction parallel to a surface of the nozzle plate substrate that faces the recording medium, and have a structure in which a change in the peak frequency showing the maximum intensity in the frequency band of 0.7 to 1.4 THz in the reflection spectrum obtained by terahertz time domain spectroscopy method is 0.2 THz or less before and after rubbing.

Here, "a change in frequency before and after rubbing" means a change in frequency between a state of non-rubbing and a state after rubbing 6000 times under a load of 13 gf by a rubber wiping blade.

Hereinafter, example embodiments will be described with reference to the drawings.

Figure 1:
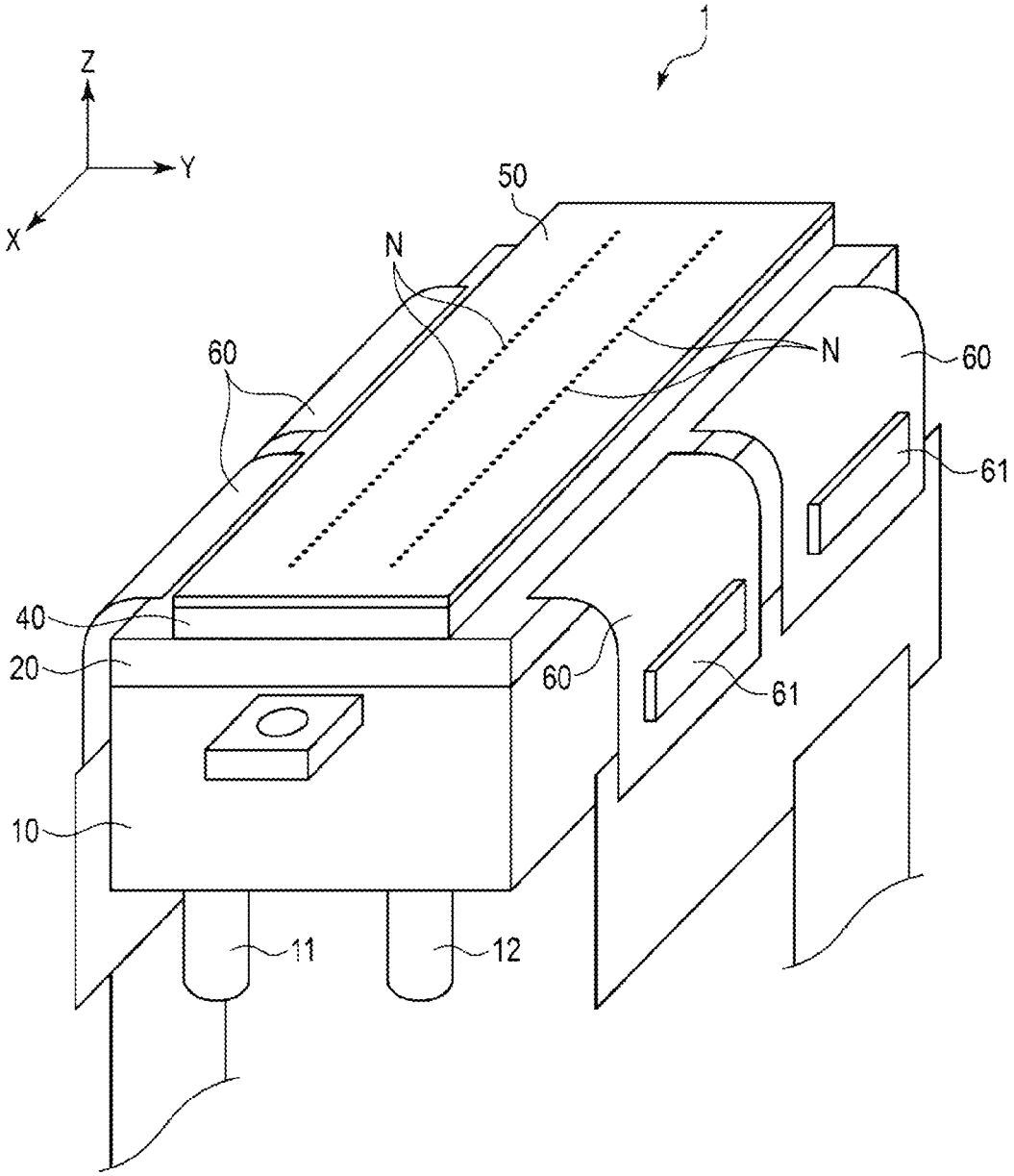
FIG. 1 is a perspective view of an inkjet head according to an embodiment.

FIG. 1 is a perspective view of an inkjet head 1 mounted on a head carriage of an inkjet printer. In the following description, an orthogonal coordinate system consisting of X axis, Y axis, and Z axis is used. For the sake of convenience, the direction pointed by the arrow in the figure is taken as the plus direction. The X axis direction corresponds to the printing width direction. The Y axis direction is a direction in which the recording medium is conveyed. The Z axis direction is perpendicular to the recording medium.

The inkjet head 1 will be described with reference to FIG. 1. The inkjet head 1 includes an ink manifold 10, an actuator substrate 20, a frame 40, and a nozzle plate 50.

The actuator substrate 20 has a rectangular shape that is long in the X axis direction. The material of the actuator substrate 20 may be, for example, alumina ($Al_2O_3$), silicon nitride ($Si_3N_4$), silicon carbide (SiC), aluminum nitride (AlN), lead zirconate titanate (PZT: $Pb(Zr, Ti)O_3$), or the like.

The actuator substrate 20 is overlaid on the ink manifold 10 so as to close the open end of the ink manifold 10. The ink manifold 10 is connected to the ink cartridge via the ink supply pipe 11 and the ink return pipe 12.

A frame 40 is attached onto the actuator substrate 20. A nozzle plate 50 is attached onto the frame 40. Nozzles N are provided in the nozzle plate 50 at fixed intervals along the X axis direction so as to form two rows along the Y axis.

Figure 2:
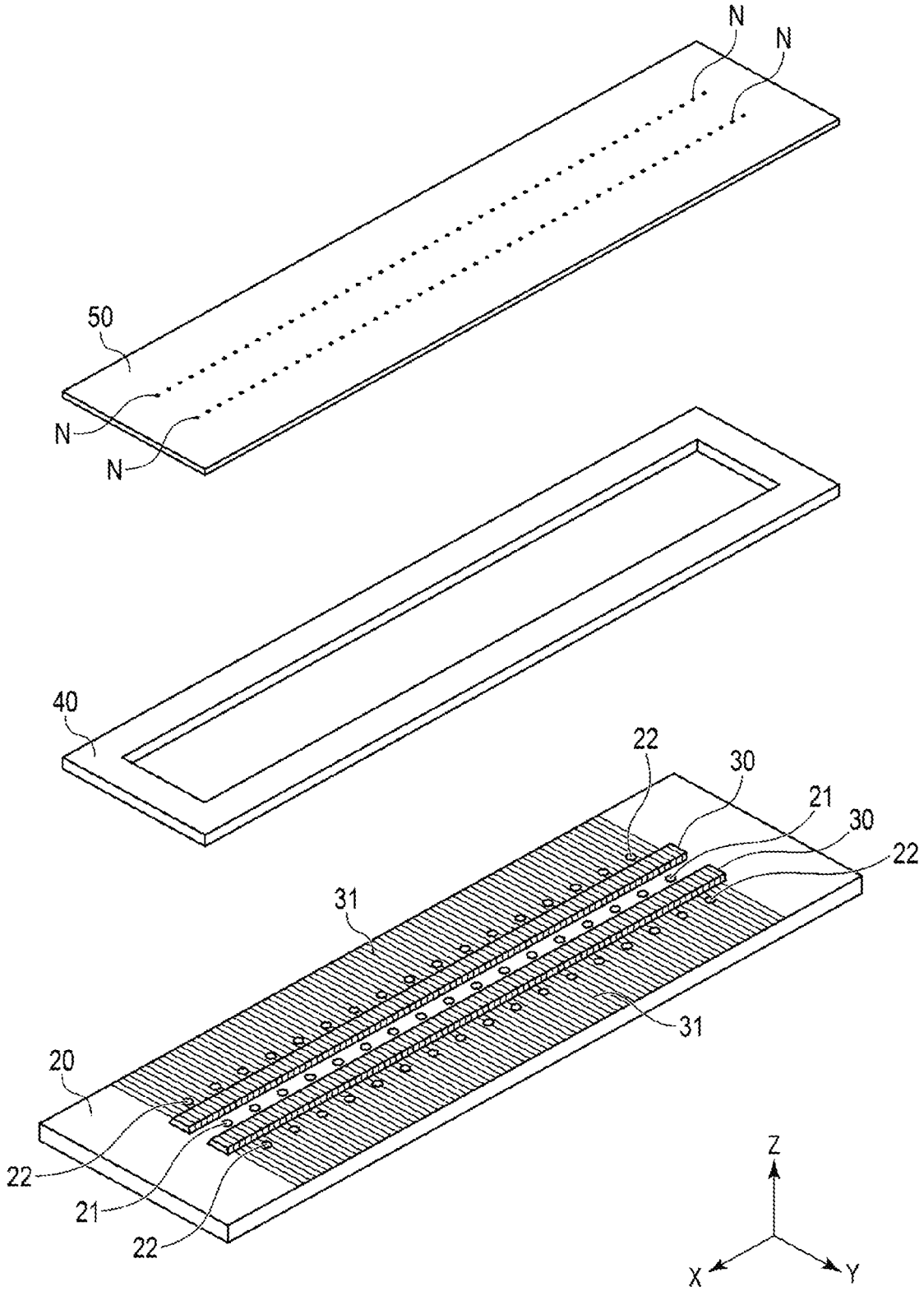
FIG. 2 is an exploded perspective view of an actuator substrate, a frame and a nozzle plate of inkjet head.

FIG. 2 is an exploded perspective view of the actuator substrate 20, the frame 40 and the nozzle plate 50 of the inkjet head 1. In the example embodiment described herein, the inkjet head 1 is a side shooter type having shear mode shared walls.

On the actuator substrate 20, ink supply ports 21 are arranged with interval along the X axis direction so as to form on either plus and minus directions in the Y axis direction. On the actuator substrate 20, ink discharge ports 22 are arranged with interval along the X axis direction so as to form rows on either plus and minus directions in the Y axis direction with respect to the row of the ink supply ports 21.

Actuators 30 are provided between a row of the central ink supply ports 21 and one row of the ink discharge ports 22. These actuators 30 form a row extending in the X-axis direction. The actuators 30 are also provided between the row of the central ink supply ports 21 and another row of the other ink discharge port 22. These actuators 30 also form a row extending in the X axis direction.

Each row of actuators 30 includes a first piezoelectric body and a second piezoelectric body laminated on the actuator substrate 20. The material of the first and second piezoelectric bodies may be, for example, lead zirconate titanate (PZT), lithium niobate ($LiNbO_3$), lithium tantalate ($LiTaO_3$), or the like. The first and second piezoelectric bodies are polarized in mutually opposite directions along the thickness direction.

Grooves each extends in the Y axis direction and arrayed along the X axis direction in the body laminated on the actuator substrate 20. These grooves are opened on the side of the second piezoelectric body and have a depth greater than the thickness of the second piezoelectric body. Hereinafter, portions of the laminated body between adjacent grooves will be referred to as a "channel wall." The channel walls each extend in the Y axis direction and are spaced from each other in the X axis direction. A groove between two adjacent channel walls is an ink channel through which ink flows.

Electrodes are formed on the side walls and the bottom of the ink channel. The electrodes are connected to the wiring pattern 31 extending along the Y axis direction.

A protective layer (not particularly depicted) is formed on the surface of the actuator substrate 20 to cover the electrode and the wiring pattern 31 except a connection portion for connecting to a flexible printed substrate. The protective layer includes may be made of inorganic insulating layers and an organic insulating layer.

The frame 40 has an opening that is smaller than the actuator substrate 20 and larger than an area of the actuator substrate 20 on which the ink supply port 21, the actuator 30, and the ink discharge port 22 are formed. The frame 40 may be made of ceramics. The frame 40 is bonded to the actuator substrate 20 by, for example, an adhesive.

The nozzle plate 50 includes a nozzle plate substrate and an oil repellent layer on the medium facing surface, from which the ink is ejected via the nozzles N. The nozzle plate substrate may be made of a resin film such as a polyimide film.

The nozzle plate 50 is larger than the opening of the frame 40. The nozzle plate 50 is bonded to the frame 40 by, for example, an adhesive.

The nozzle plate 50 is provided with a plurality of nozzles N. The nozzles N form two rows corresponding to ink channels. The diameter of each nozzle N increases in the direction of the ink channel from the recording medium facing surface. The size of the nozzle N is set to a predetermined value according to the desired amount of ink to be ejected. The nozzle N can be formed, for example, using an excimer laser.

The actuator substrate 20, the frame 40 and the nozzle plate 50 are integrated to form a hollow structure as shown in FIG. 1. A region surrounded by the actuator substrate 20, the frame 40 and the nozzle plate 50 acts as an ink circulation chamber. The ink is supplied from the ink manifold 10 to the ink circulation chamber through the ink supply port 21, passes through the ink channel, and circulates so that surplus ink returns from the ink discharge port 22 to the ink manifold 10. Some of the ink is ejected from the nozzle N as it is flowing through the ink channel and used for printing.

A flexible printed circuit board 60 is connected to the wiring pattern 31 at a position outside the frame 40 on the actuator substrate 20. A drive circuit 61 for driving the actuator 30 is mounted on the flexible printed circuit board 60.

Hereinafter, the operation of the actuator 30 will be described. Here, the middle of the three neighboring ink channels is focused upon, and the operations thereof will be described. The ink channel in the middle may be referred to as a middle ink channel and the ink channels on either sides of the middle ink channel may be referred to as side ink channels. Electrodes corresponding to the three neighboring ink channels are referred to as electrodes A, B and C (electrode A and C correspond to the side ink channels and electrode B corresponds to the middle ink channel). When no electric field is applied in a direction perpendicular to the channel wall, the channel walls are in an erect state.

For example, a voltage pulse having a potential that is higher than the potentials of the electrodes A and C on both sides is applied to the electrode B to generate an electric field in a direction perpendicular to the channel wall. Thus, the channel wall is driven in a shear mode and the channel walls of the middle ink channel are deformed to expand the volume of the middle ink channel.

A voltage pulse with a potential higher than the potential of the electrode B is applied to the electrodes A and to generate an electric field in a direction perpendicular to the channel walls. In this way, the channel walls are driven in a shear mode and the channel walls of the middle ink channel are deformed to reduce the volume of the middle ink channel. Due to the expansion and the contraction, a variable pressure is applied to the ink in the middle ink channel, and the ink is ejected from the nozzles N corresponding to the middle ink channel onto the recording medium in conjunction with pressure increases.

In some embodiments, the nozzles are divided into three groups such that the driving operation is performed in three cycles under time division control, and printing on the recording medium is thus performed.

Figure 3:
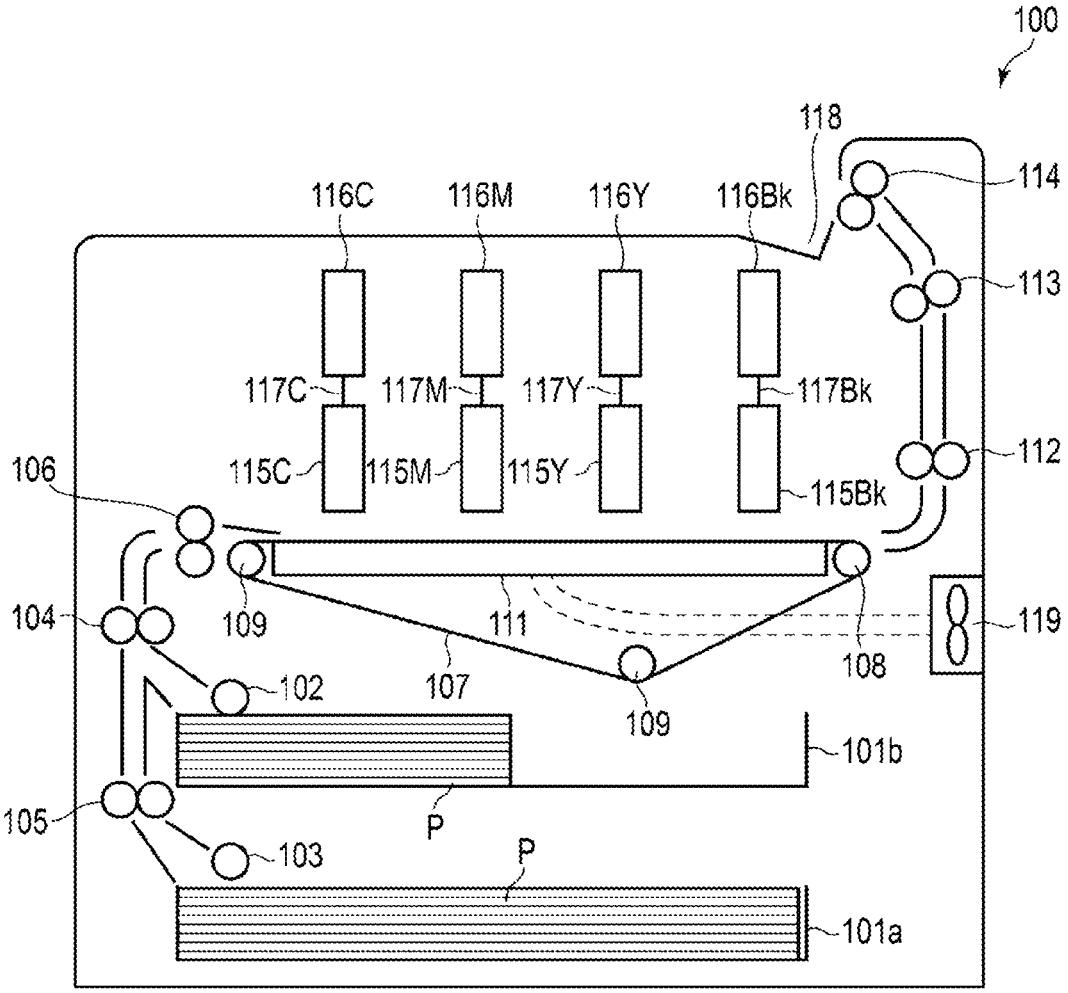
FIG. 3 is a schematic view of an inkjet printer according to the embodiment.

FIG. 3 shows a schematic view of the inkjet printer 100. The inkjet printer 100 shown in FIG. 3 includes a housing provided with a paper discharge tray 118. Cassettes 101*a* and 101*b*, paper feed rollers 102 and 103, pairs of conveying rollers 104 and 105, a pair of registration roller 106, a conveyor belt 107, a fan 119, a negative pressure chamber 111, pairs of conveying rollers 112, 113 and 114, inkjet heads 115C, 115M, 115Y and 115Bk, ink cartridges 116C, 116M, 116Y and 116Bk, and tubes 117C, 117M, 117Y and 117Bk are installed in the housing.

The cassettes 101*a* and 101*b* contain recording medium P having different sizes. The paper feed roller 102 or 103 takes out the recording medium P corresponding to the size of the selected recording medium from the cassette 101*a* or 101*b* and conveys it to the pairs of conveying rollers 104 and 105 and the pair of registration roller 106.

The conveyor belt 107 is given tension by the driving roller 108 and two driven rollers 109. Holes are formed at predetermined intervals on the surface of the conveyor belt 107. A negative pressure chamber 111 connected to the fan 119 for adsorbing the recording medium P to the conveyor belt 107 is installed inside the conveyor belt 107. On the downstream side in the conveying direction of the conveyor belt 107, the pairs of conveying rollers 112, 113 and 114 are installed. A heater for heating the printing layer formed on the recording medium P can be installed in the conveying path from the conveyor belt 107 to the paper discharge tray 118.

In FIG. 3, four inkjet heads for ejecting ink onto the recording medium P in accordance with the image data are arranged above the conveyor belt 107. Specifically, an inkjet head 115C that ejects cyan (C) ink, an inkjet head 115M that ejects magenta (M) ink, an inkjet head 115Y that ejects yellow (Y) ink, and an inkjet head 115Bk that ejects black (Bk) ink are arranged in this order from the upstream side. Each of the inkjet heads 115C, 115M, 115Y and 115Bk is the inkjet head 1 described with reference to FIGS. 1 and 2.

A cyan (C) ink cartridge 116C, a magenta (M) ink cartridge 116M, a yellow (Y) ink cartridge 116Y, and a black (Bk) ink cartridge 116Bk, which contain inks corresponding the inkjet heads 115C, 115M, 115Y and 115Bk, respectively, are arranged above the inkjet heads 115C, 115M, 115Y and 115Bk. These cartridges 116C, 116M, 116Y and 116Bk are connected to inkjet heads 115C, 115M, 115Y and 115Bk by tubes 117C, 117M, 117Y and 117Bk, respectively.

Next, an image forming operation of the inkjet printer 100 will be described. First, image processing means (not specifically depicted) of the inkjet printer 100 starts image processing for recording, generates an image signal corresponding image data, and generates control signals for controlling operations of various rollers, the negative pressure chamber 111, and the like.

Under the control of the image processing means, the paper feed roller 102 or 103 picks up the recording medium P having the selected size one by one from the cassette 101*a* or 101*b*, and conveys it to the pairs of conveying rollers 104 and 105 and the pair of registration roller 106. The pair of registration roller 106 corrects the skew of the recording medium P and transports the recording medium P at a predetermined timing.

The negative pressure chamber 111 suctions air through the holes of the conveyor belt 107. Accordingly, in a state in which the recording medium P is adsorbed to the conveyor belt 107, the recording medium P is conveyed in consecutive order under the inkjet heads 115C, 115M, 115Y and 115Bk as movement of the conveyor belt 107.

Under the control of the image processing means, the inkjet heads 115C, 115M, 115Y and 115Bk eject ink in synchronization with the timing at which the recording medium P is conveyed. As a result, a color image is formed at a desired position on the recording medium P.

Thereafter, the pairs of conveying rollers 112, 113, and 114 discharge the recording medium P on which the image is formed to paper discharge tray 118. If a heater is installed in the conveying path from the conveyor belt 107 to the paper discharge tray 118, the printed layer formed on the recording medium P may be heated by the heater. In particular, if the recording medium P is impermeable, the heating of the printed layer enhances adherence of the printing layer to the recording medium P.

Figure 4:
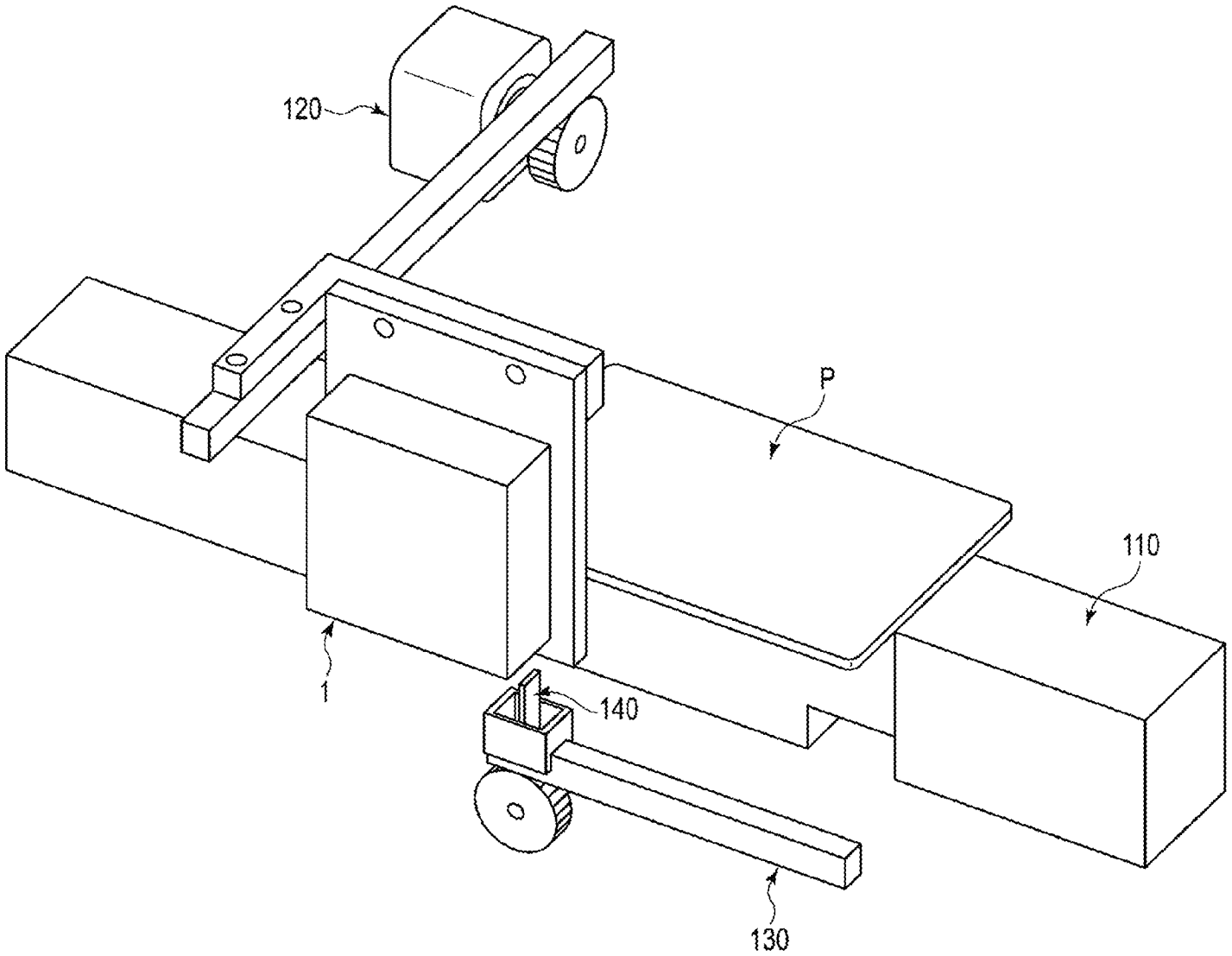
FIG. 4 is an exploded perspective view of an inkjet printer according to the embodiment.

FIG. 4 is an exploded perspective view of the inkjet printer 100. FIG. 4 illustrates the inkjet head 1 described above, a medium holding mechanism 110, a head moving mechanism 120, a blade moving mechanism 130, and a wiping blade 140.

The medium holding mechanism 110 holds a recording medium P such as recording paper, to face the inkjet head 1. The medium holding mechanism 110 also has a function as a recording paper transferring mechanism for transferring the recording medium. The medium holding mechanism 110 includes a conveyor belt 107, a driving roller 108, a driven roller 109, a negative pressure chamber 111, and a fan 119 (depicted in FIG. 3). At the time of printing, the medium holding mechanism 110 transfers the recording medium P in a direction parallel to the printed surface of the recording medium P while the recording medium P faces the inkjet head 1. During this transfer, the inkjet head 1 ejects ink droplets from the nozzles to print on the recording medium P.

At the time of printing, the head moving mechanism 120 moves the inkjet head 1 to the printing position. Further, at the time of cleaning, the head moving mechanism 120 moves the inkjet head 1 to the cleaning position.

The wiping blade 140 rubs the recording medium facing surface of the nozzle plate of the inkjet head 1 to remove ink from the recording medium facing surface.

The blade moving mechanism 130 moves the wiping blade 140. Specifically, after the head moving mechanism 120 moves the inkjet head 1 to the cleaning position, the blade moving mechanism 130 moves the wiping blade 140 while pressing the wiping blade 140 against the recording medium facing surface of the nozzle plate 50. As a result, the ink adhering to the recording medium facing surface of the nozzle plate 50 is removed.

The wiping blade 140 and the blade moving mechanism 130 may be omitted.

In the inkjet head 1, an oil repellent film is applied on the medium facing surface of the nozzle plate 50. The oil repellent layer may be formed of a fluorine-based compound.

In the example embodiments described herein, the oil repellent layer includes a fluorine-based compound cross-linked between neighboring molecules in a direction parallel to the medium facing surface of the nozzle plate substrate, and has a structure in which the surface bonding state does not change by rubbing.

Alternatively, the oil repellent layer may include a fluorine-based compound cross-linked between neighboring molecules in a direction parallel to the medium facing surface of the nozzle plate substrate, and has a structure in which a change in the peak frequency showing the maximum intensity in the frequency band of 0.7 to 1.4 THz in the reflection spectrum obtained by terahertz time domain spectroscopy method is 0.2 THz or less before and after rubbing.

Such an oil repellent layer is hardly deteriorated in ink repellency. The reason will be explained below.

Figure 5:
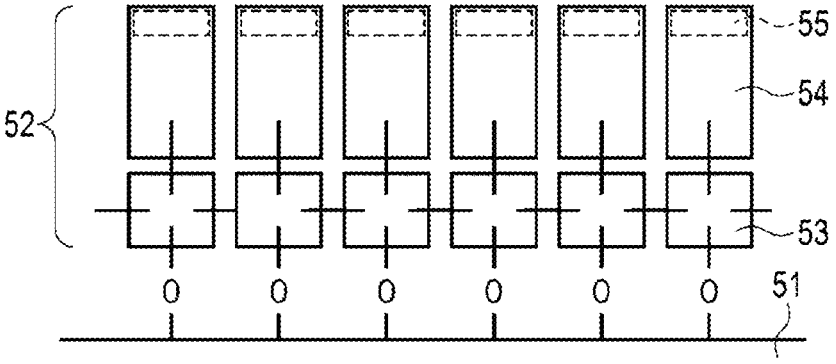
FIG. 5 is a schematic view of an oil repellent layer in an inkjet head according to the embodiment.

FIG. 5 is a schematic diagram of the oil repellent layer 52 bonded to the medium facing surface of the nozzle plate substrate 51.

The fluorine-based compound has a bonding site bonded to the nozzle plate substrate and a terminal perfluoroalkyl group. For example, the fluorine-based compound is a linear molecule having a substrate bonding site at one end and a perfluoroalkyl group at the other end.

The bonding site is a portion of the compound which may form a chemical bond to the nozzle plate substrate, for example, by a reaction with a functional group on the surface of the nozzle plate substrate. The bonding site may itself contain a reactive functional group. In this case, the reactive functional group reacts with the functional group on the surface of the nozzle plate substrate, whereby the bonding site is bonded to the nozzle plate substrate. The reactive functional group is, for example, an unsaturated hydrocarbon group such as an epoxy group, an amino group, a methacryl group, and a vinyl group, or a mercapto group. The functional group on the surface of the nozzle plate substrate is, for example, a hydroxyl group, an ester bonding group, an amino group, or a thiol group. Alternatively, the bonding site may be an alkoxysilane group. In this case, the silanol groups generated by the hydrolysis of the alkoxysilane groups react with functional groups such as hydroxyl groups existing on the surface of the nozzle plate substrate, so that the bonding sites are bonded to the nozzle plate substrate.

Bonding sites of the fluorine compounds are also bonded to bonding sites of adjacent fluorine compounds on the nozzle plate substrate. In some embodiments, each bonding site further comprises one or more silicon atoms between the reactive functional group and the terminal perfluoroalkyl group, and the bonding sites of the neighboring fluorine compounds on the nozzle plate substrate are bonded to each other by the siloxane bond (Si—O—Si).

The terminal perfluoroalkyl group is, for example, a linear perfluoroalkyl group. The number of carbon atoms of the terminal perfluoroalkyl group can be selected, for example, from a range of 3 to 7 (referred to as C3 to C7). It is preferable that the terminal perfluoroalkyl group erects along the perpendicular direction of the nozzle plate substrate.

This fluorine-based compound may further include a spacer linking group that is between the bonding site which bonds to the nozzle plate substrate and the terminal perfluoroalkyl group. The presence of such a spacer linking group can be advantageous for providing a film in which the terminal perfluoroalkyl groups are erect in a direction perpendicular to the nozzle plate substrate. The spacer linking group is, for example, a perfluoropolyether group.

Examples of a fluorine-based compound include compounds represented by the following general formula (1) or (2).

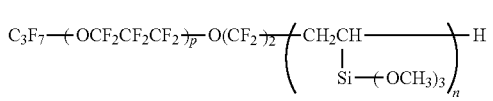

(1)

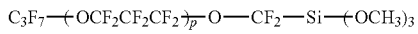

(2)

In Formula (1), p is a value from 1 to 50, and n is a value from of 1 to 10. While each molecule of the fluorine compound has only integer values for p (1 to 50), each molecule of the fluorine compound in a film does not necessarily need to have the same p value and, when referring to the composition of a film, collectively, the value of p need not be an integer value and may represent an averaged value of all fluorine compound molecules in the film (or a measured region of the film) that is a natural number.

In the general formula (2), p is also a value of 1 to 50 in the same manner as was described as within the context of Formula (1).

FIG. 5 is a schematic diagram of the oil repellent layer 52 bonded to the medium facing surface of the nozzle plate substrate 51.

The coating structure can be obtained, for example, as follows. In the example embodiment described herein, it is assumed that a hydroxyl group will be initially present on an exposed surface of the nozzle plate substrate 51, and the fluorine-based compound contains an alkoxysilane group at the bonding site thereof.

When an alkoxysilane group of a fluorine-based compound is hydrolyzed, a silanol group is formed. The silanol group and the hydroxyl group on the medium facing surface of the nozzle plate substrate 51 react via a dehydration condensation. In this way, the nozzle plate substrate 51 and the fluorine-based compound are bonded to each other via a siloxy group (Si—O—) of silicon atoms in the bonding site 53. Silicon atoms at the bonding site 53 of the fluorine compound are also bonded to bonding sites of adjacent fluorine compounds by a siloxane bond (Si—O—Si).

As a result, the bonding site 53 forms a cross-linked structure horizontal to the medium facing surface of the nozzle plate substrate 51.

The terminal perfluoroalkyl group 55 is bound to the silicon atom of the bonding site 53 via a perfluoropolyether group (a spacer linking group 54). As described above, the spacer linking group 54 permits the terminal perfluoroalkyl groups 55 be erect in a direction perpendicular to the nozzle plate substrate 51. In this arrangement, terminal perfluoroalkyl groups 55 provide ink repellency. Further, the terminal perfluoroalkyl group 55 is represented by CF3-CF2-CF2-, for example, when the carbon number is 3 (C3). In this case, the ink repellency of the CF3 group is higher than that of the CF2 group.

In the structure shown in FIG. 5, the terminal perfluoroalkyl group 55 stands upright (is erect) along the direction perpendicular to the nozzle plate substrate 51. In such a structure, even when a cleaning by the wiping blade 140 is repeated, the terminal perfluoroalkyl group 55 only swings in the lateral direction and will not be removed from the surface of the oil repellent layer 52.

Figure 6:
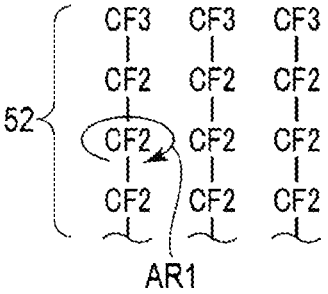
FIG. 6 is a schematic view of a surface bonding state when an oil repellent layer is rubbed.
Figure 7A:
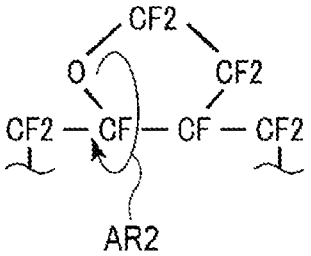
FIG. 7A is a schematic view of a surface bonding state of an oil repellent layer before being rubbed in a comparative example.
Figure 7B:
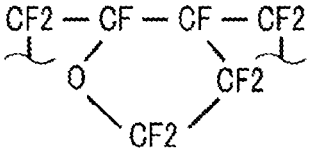
FIG. 7B is a schematic view of a surface bonding state of the oil repellent layer shown in FIG. 7A after being rubbed.

FIG. 6 is a schematic view of a surface bonding state when the oil repellent layer is rubbed. FIG. 7A is a schematic view of a surface bonding state before being rubbed in a comparative example. FIG. 7B is a schematic view of a surface bonding state of the oil repellent layer shown in FIG. 7A after being rubbed.

In FIG. 6 and FIGS. 7A and 7B, a top surface is the uppermost surface of the oil repellent layer, and the nozzle plate substrate 51 is below the oil repellent layer 52.

Here, the surface bonding state represents the kind and proportion of chemical bonds existing on the surface of the oil repellent layer, that is, the type and proportion of functional groups existing on the surface of the oil repellent layer.

In the structure shown in FIG. 6, the perfluoroalkyl group exists in the vicinity of the surface of the oil repellent layer 52. A layer made of a fluorine-based compound containing a perfluoroalkyl group is relatively soft. Thus, when rubbing the layer, there is a possibility that the perfluoroalkyl group causes a conformational change. The perfluoroalkyl group can cause a rotational conformational change about an axis parallel to a length direction thereof, as indicated by the arrow AR1 in FIG. 6. Although other conformational changes may occur, functional groups (that is, CF3 group and CF2 group) on the outermost surface of the oil repellent layer 52 are not greatly altered. Thus, the oil repellent layer 52 shown in FIG. 6 has a structure in which the surface bonding state is not altered by rubbing.

In the structure shown in FIG. 7A, a functional group (that is, a CF2O group or the like) exists on the outermost surface of the oil repellent layer. However, when rubbing the oil repellent layer, the heterocyclic moiety rotates in a direction indicated by the arrow AR2 in FIG. 7A. That is, the conformation changes as shown in FIG. 7B. Once this conformation changes, this structure is more stable than the original structure, and therefore the surface bonding state will not return to the original structure shown in FIG. 7A, even after rubbing the oil repellent layer several times. In the structure shown in FIG. 7B, the functional group (that is, the CF2O group) on the outermost surface of the oil repellent layer has excellent oil repellency and is smaller in size than the original structure shown in FIG. 7A. That is, the oil repellent layer having the structure shown in FIG. 7A has a structure in which the surface bonding state is changed by rubbing.

The oil repellent layer having the structure as depicted in FIG. 6 does not lead to deterioration of the ink repellency due to rubbing.

The surface bonding state of the oil repellent layer formed on the recording medium facing surface of the nozzle plate can be analyzed by X-ray photoelectron spectroscopy (XPS), for example.

When a substance is irradiated with an X-ray having several keV, bonded electrons in an atomic orbit absorb energy and are released as photoelectrons. The binding energy $E_b$ of the bonded electrons and the kinetic energy $E_k$ of the photoelectron have the following relationship.

$$E_b = h\nu - E_k - \psi_{sp}$$

Here, hν is the energy of the incident X-ray, and $\psi_{sp}$ is the work function of the spectroscope.

Therefore, if the energy hν of X-rays is known (that is, a wavelength of the X ray is known), the bonding energy $E_b$ of the bound electrons can be obtained based on the kinetic energy $E_k$ of photoelectrons. Since the bonding energy $E_b$ of the bound electrons is unique to each element, constituent elements of the substance can be analyzed. Since a shift in the bonding energy measured by the spectroscope corresponds to a change in a chemical bonding state and valence electron state (such as oxidation number) of the constituent elements, the chemical bonding state of the constituent elements can be examined.

As shown in FIG. 5, when the terminal perfluoroalkyl group 55 has an upright structure along the perpendicular direction of the nozzle plate substrate 51, the CF3 group exists on the outermost surface of the oil repellent layer 52, and the CF2 group exists on the side of the nozzle plate substrate 51 opposite to the outermost surface.

When this oil repellent layer 52 is analyzed by the X-ray photoelectron spectroscopy (XPS) method, a peak of a CF2 group and a peak of a CF3 group are both detected.

Analysis of the surface bonding state of the oil repellent layer by the XPS method involves destruction of the sample. To investigate a change in the surface bonding state of the oil repellent layer formed on the recording medium facing surface of the nozzle plate without destroying the sample, the change may be analyzed, for example, by a terahertz time domain spectroscopy (THz-TDS) method. According to this method, it is possible to non-destructively analyze the change in the surface bonding state of the same oil repellent layer before and after rubbing.

Specifically, a reflection spectrum is obtained using the terahertz time domain spectroscopy method for both before and after rubbing the oil repellent layer. Then, by comparing the reflection spectrum, a change in the surface bonding state of the oil repellent layer is confirmed.

The acquisition of reflection spectrum using the terahertz time domain spectroscopy method will be described below.

First, the light pulse emitted by the femtosecond laser is split into pump light and probe light by the beam splitter.

The pump light leads to the terahertz wave generating element. A terahertz wave generating element generates a terahertz pulse wave. The terahertz pulse wave leads to a sample, and the terahertz pulse wave reflected by the sample leads to the detection element.

The probe light leads to the detection element. On the optical path leading the probe light, a movable mirror is installed. By moving this movable mirror, the time waveform of the oscillating electric field of the terahertz pulse wave is measured while changing the timing at which the probe light leads to the detection element.

Figure 10:
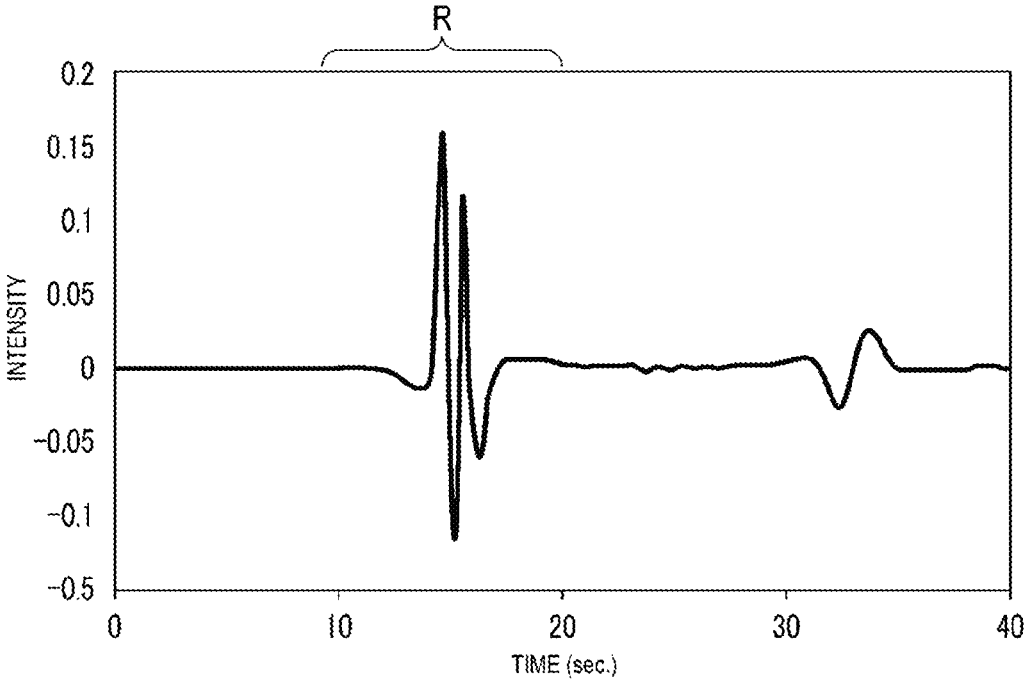
FIG. 10 depicts an example of a time waveform of an oscillating electric field of a terahertz pulse wave.

FIG. 10 depicts an example of the time waveform of the oscillating electric field of the terahertz pulse wave obtained in this way. In FIG. 10, the horizontal axis represents time and the vertical axis represents the intensity of the oscillating electric field of the terahertz pulse wave.

In the time waveform of the oscillating electric field of the terahertz pulse wave, the first appearing peak reflects the state near the outermost surface of the sample. The second appearing peak reflects the state near the second interface when the outermost surface of the sample is taken as the first interface. Therefore, a portion including the first and second peaks in the time waveform of the oscillating electric field of the terahertz pulse wave is used for analysis. That is, a reflection spectrum is obtained by performing Fourier transformation on the region R shown in FIG. 10.

For obtaining the reflection spectrum, for example, TAS 7500 SP (Advantest Co.) can be used.

The comparison between the reflection spectrum obtained before and after rubbing the oil repellent layer is performed as follows.

First, for each of the reflection spectrum, a peak showing the maximum intensity in the frequency band of 0.7 to 1.4 THz is specified. The reflection spectrum obtained for an oil repellent layer in which most of the groups existing on the outermost surface are perfluoroalkyl groups has a peak in the frequency band of 0.7 to 1.4 THz.

Next, the difference between the peak frequency specified in the reflection spectrum obtained before rubbing the oil repellent layer and the peak frequency specified in the reflection spectrum obtained after rubbing the oil repellent layer are obtained. When the absolute value of this difference, that is, the frequency change is 0.2 THz or less, it is determined that the surface bonding state of the oil repellent layer is not changed before and after the rubbing.

The change in the peak frequency showing the maximum intensity before and after rubbing is preferably 0.2 THz or less, and more preferably 0.1 THz or less. If the change in the peak frequency showing the maximum intensity in the frequency band of 0.7 to 1.4 THz in the reflection spectrum is too large before and after rubbing, the deterioration of the ink repellency due to the rubbing may increase. Such a significant change in the frequency suggests that the same rotation as described above occurred within the oil repellent layer.

EXAMPLES

Comparative Example

First, Cytop® (A type) manufactured by Asahi Glass Co., Ltd. represented by the following chemical formula was prepared as the material of the oil repellent layer of the comparative example. The material of the oil repellent layer is a fluorine-based compound and has terminal groups containing an alkoxysilane group at both ends of a polymer main chain represented by the following chemical formula. End groups are not specifically depicted in the formula below.

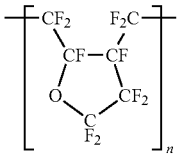

CYTOP® was applied to the surface of the nozzle plate substrate, and the alkoxysilane end groups at both terminal ends of the CYTOP® molecules were reacted with hydroxyl groups on the nozzle plate substrate surface. In this manner, CYTOP® was thus bonded to the surface of the nozzle plate substrate.

A hydroxyl group exists on the medium facing surface of the nozzle plate substrate. Both terminal groups of the fluorine-based compound combine with the hydroxyl group and become a bonding site. A polymer main chain of the fluorine-based compound exists between the two v sites. The CF2O group of the polymer main chain in the fluorine-based compound exerts mainly ink repellency.

However, it was found that when the oil repellent layer formed on the medium facing surface of the nozzle plate substrate was rubbed by the wiping blade 140, the ink repellency deteriorated.

Figure 8:
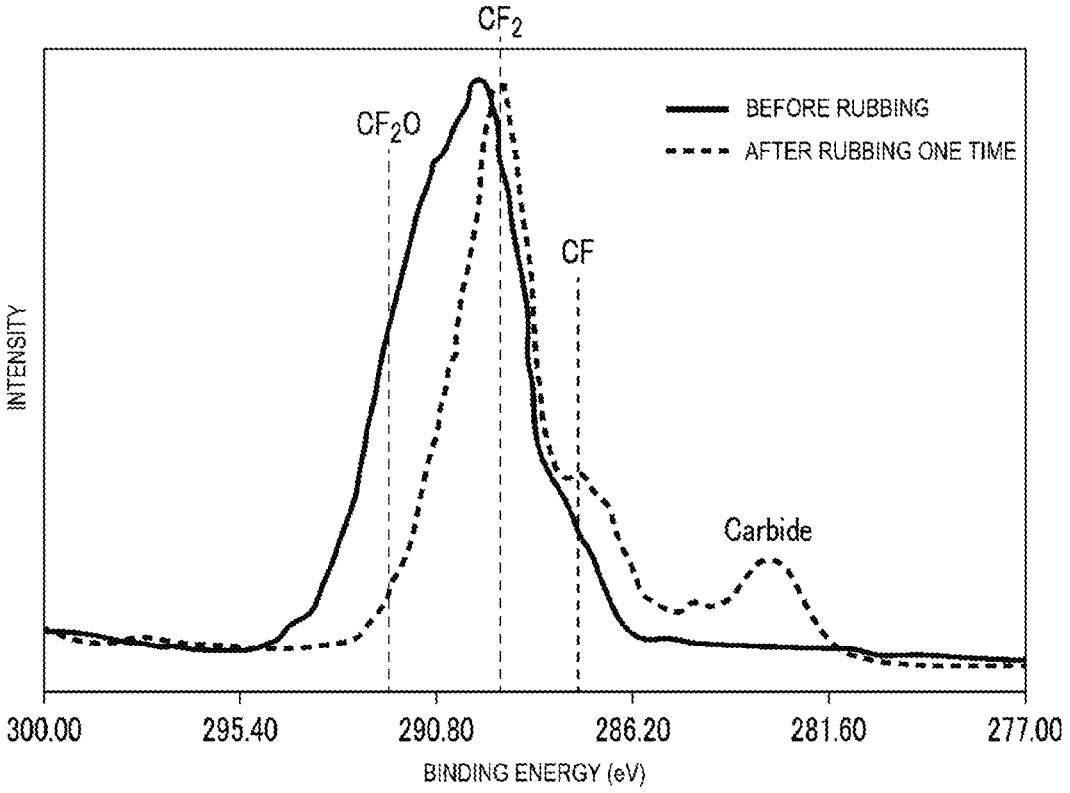
FIG. 8 depicts XPS spectrum obtained on a surface of an oil repellent layer of a nozzle plate according to the comparative example before and after being rubbed one time.

FIG. 8 shows X-ray photoelectron spectroscopy (XPS) spectrum obtained on the surface of the oil repellent layer of the nozzle plate of the comparative example before being rubbed with the wiping blade and after being rubbed one time. In FIG. 8, the horizontal axis represents binding energy and the vertical axis represents intensity of emitted photoelectrons.

In FIG. 8, the XPS spectrum obtained before rubbing the nozzle plate with the wiping blade indicates that many CF2O groups exist on the surface of the oil repellent layer. The XPS spectrum obtained after rubbing the nozzle plate one time with the wiping blade indicates that the CF2O group was drastically decreased from the surface of the oil repellent layer.

As explained with reference to FIGS. 7A and 7B, due to rubbing the nozzle plate with the wiping blade 140, the CF2O group may have rotated around the polymer main chain (conformation change occurred) and moved from the surface of the oil repellent layer into the inside of the oil repellent layer.

Example Embodiment

In the example embodiment described herein, an evaporation source containing a fluorine-based compound represented by the following chemical formula was prepared. The evaporation source and the nozzle plate substrate were placed in a vacuum evaporation apparatus and a fluorine-based compound was deposited on the recording medium facing surface of the nozzle plate substrate by a vapor deposition method. In this way, an oil repellent layer was formed on the recording medium facing surface of the nozzle plate substrate.

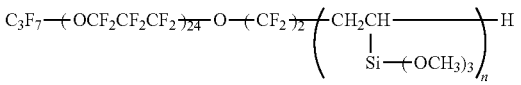

The nozzle plate was rubbed with a wiping blade with varied loads. Thereafter, the surface of the oil repellent layer was analyzed by the XPS method.

Figure 9:
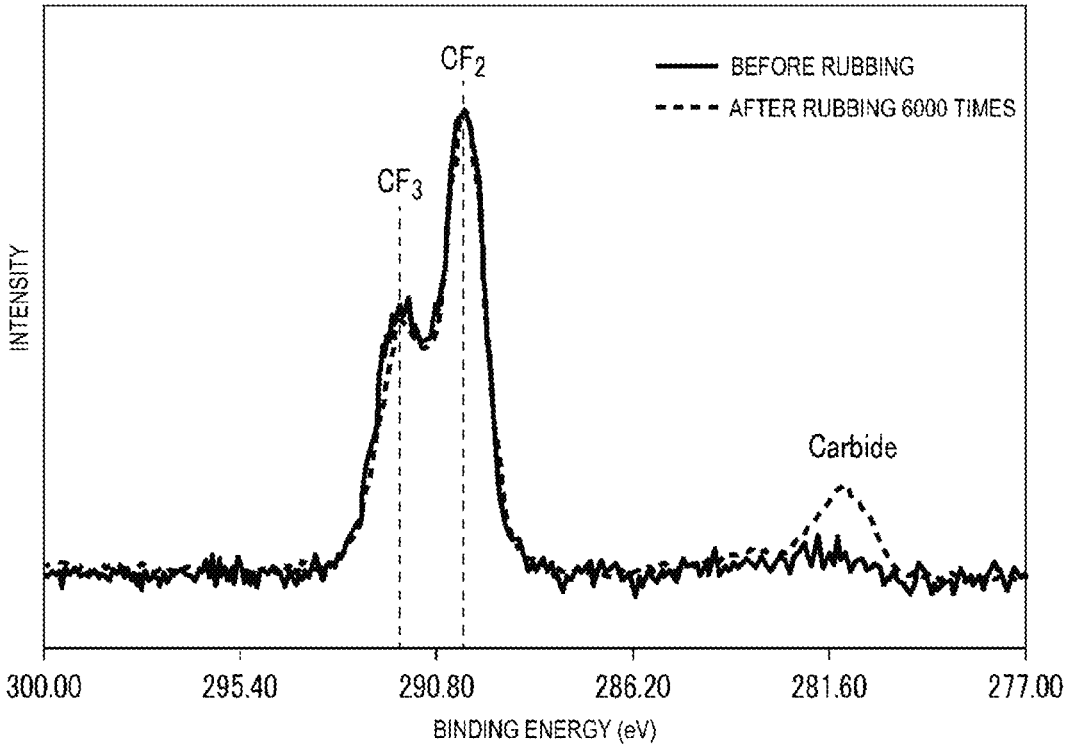
FIG. 9 depicts XPS spectrum obtained on a surface of an oil repellent layer of a nozzle plate according to the embodiment before being rubbed with a wiping blade and after being rubbed 6000 times.

FIG. 9 shows X-ray photoelectron spectroscopy (XPS) spectrum obtained on the surface of the oil repellent layer of the nozzle plate according to the embodiment before being rubbed with the wiping blade and after being rubbed 6000 times. In FIG. 9, the horizontal axis represents binding energy and the vertical axis represents the intensity of emitted photoelectrons.

In FIG. 9, the obtained XPS spectrum indicates that the ratio of the CF3 group existing on the surface of the oil repellent layer is substantially maintained before and after rubbing the nozzle plate with the wiping blade.

Next, the reflection spectrum of the oil repellent layer according to the embodiment and the comparative example before and after rubbing the oil repellent layer with the wiping blade was measured by terahertz time domain spectroscopy method. Here, the reflection spectrum was obtained by performing Fourier transformation on the region R including the first and second peaks in the time waveform of the oscillating electric field of the terahertz pulse wave shown in FIG. 10. Measurement of terahertz time domain spectroscopy method was performed using TAS 7500 SP (Advantest Co.).

Figure 11:
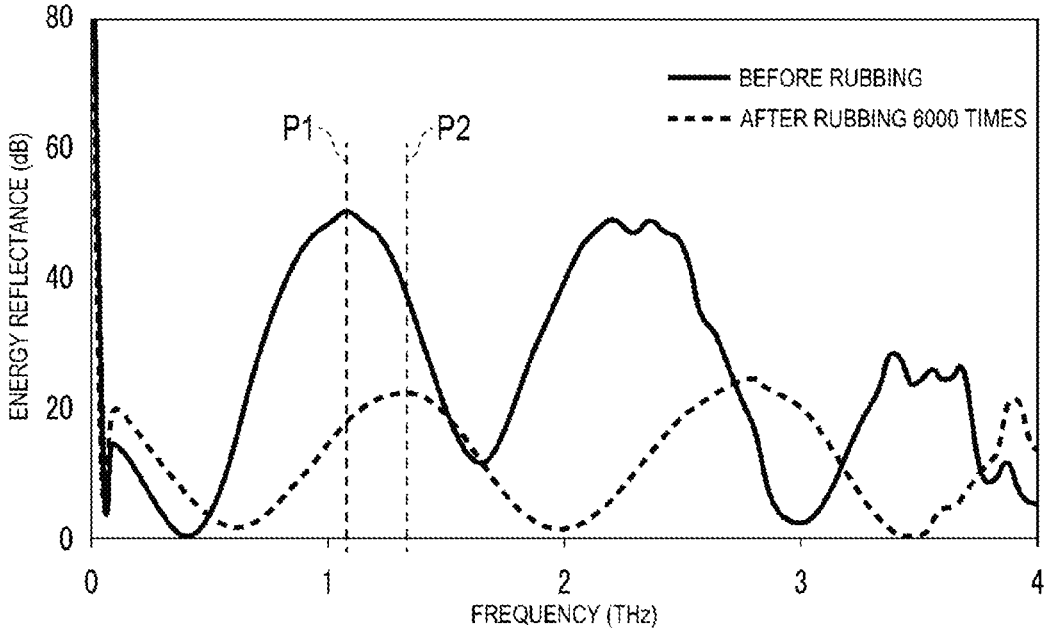
FIG. 11 depicts reflection spectrum obtained for an oil repellent layer of a nozzle plate according to the comparative example before being rubbed with a wiping blade and after being rubbed 6000 times.
Figure 12:
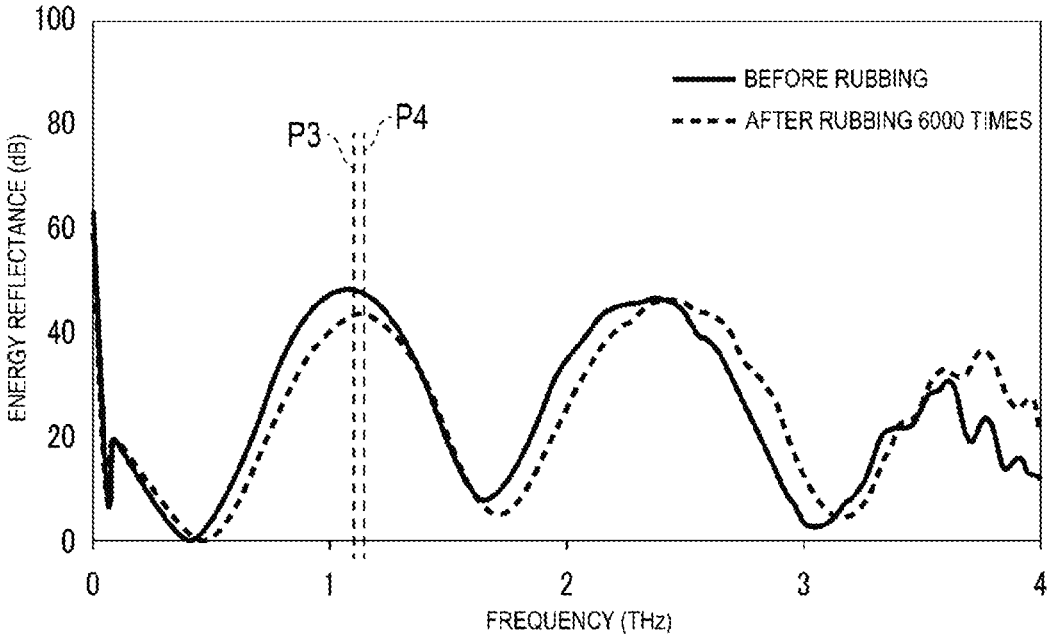
FIG. 12 depicts reflection spectrum obtained for an oil repellent layer of a nozzle plate according to the embodiment before being rubbed with a wiping blade and after being rubbed 6000 times.

FIG. 11 depicts reflection spectrum obtained for the oil repellent layer of the nozzle plate of the comparative example before being rubbed with the wiping blade and after being rubbed 6000 times. FIG. 12 depicts reflection spectrum for an oil repellent layer of the nozzle plate according to the embodiment before being rubbed with a wiping blade and after being rubbed 6000 times. In FIGS. 11 and 12, the horizontal axis represents frequency and the vertical axis represents energy reflectance. P1 to P4 indicate the peak frequency showing the maximum intensity in the frequency band of 0.7 to 1.4 THz for each of the reflection spectrum. In this case, a wiping blade made of rubber was used, and the load was 13 gf.

With respect to the reflection spectrum of the oil repellent layer before rubbing the nozzle plate of the comparative example, the peak showing the maximum intensity in the frequency band of 0.7 to 1.4 THz was 1.05 THz. With respect to the reflection spectrum of the oil repellent layer after rubbing the nozzle plate of the comparative example 6000 times, the peak showing the maximum intensity in the frequency band of 0.7 to 1.4 THz was 1.36 THz. That is, the frequency largely changed.

With respect to the reflection spectrum of the oil repellent layer before rubbing the nozzle plate according to the embodiment, the peak showing the maximum intensity in the frequency band of 0.7 to 1.4 THz was 1.11 THz. With respect to the reflection spectrum of the oil repellent layer after rubbing the nozzle plate according to the embodiment 6000 times, the peak showing the maximum intensity in the frequency band of 0.7 to 1.4 THz was 1.13 THz. That is, there was hardly any change in frequency.

In other words, the surface bonding state of the nozzle plate according to the embodiment is not changed before and after rubbing.

Next, the relationship between the number of times of rubbing with the wiping blade and the speed at which the nozzle plate ejects ink with respect to the nozzle plate according to the embodiment and the comparative example was examined.

Measurement of the speed at which ink is ejected was carried out as follows. A sample nozzle plate (having an oil repellent layer with a width of 15 mm thereon) was prepared. The nozzle plate was held at one end and substantially immersed in ink while in a substantially erect state (e.g., perpendicular to an upper surface of the ink), the nozzle plate was then pulled out from the ink by a length of 45 mm, and the time required for the ink to disappear from the now exposed portion (45 mm of the plate) after the pulling out was measured.

The speed Rr (as mm/sec) at which ink flows off the oil repellent film is defined as follows, assuming that the length of the oil repellent layer immersed in the ink is L (here, L=45 mm), and the time required for the ink to disappear from the pulled up portion is T.

$$R_r(\text{in mm/sec})=L/T=45\ \text{mm}/T$$

The nozzle plate provided with the oil repellent layer was rubbed with a wiping blade under a load of 13 gf (gram force) for a predetermined number of times. Thereafter, the speed $R_r$ at which the ink is ejected was measured again by the same method as described above.

Figure 13:
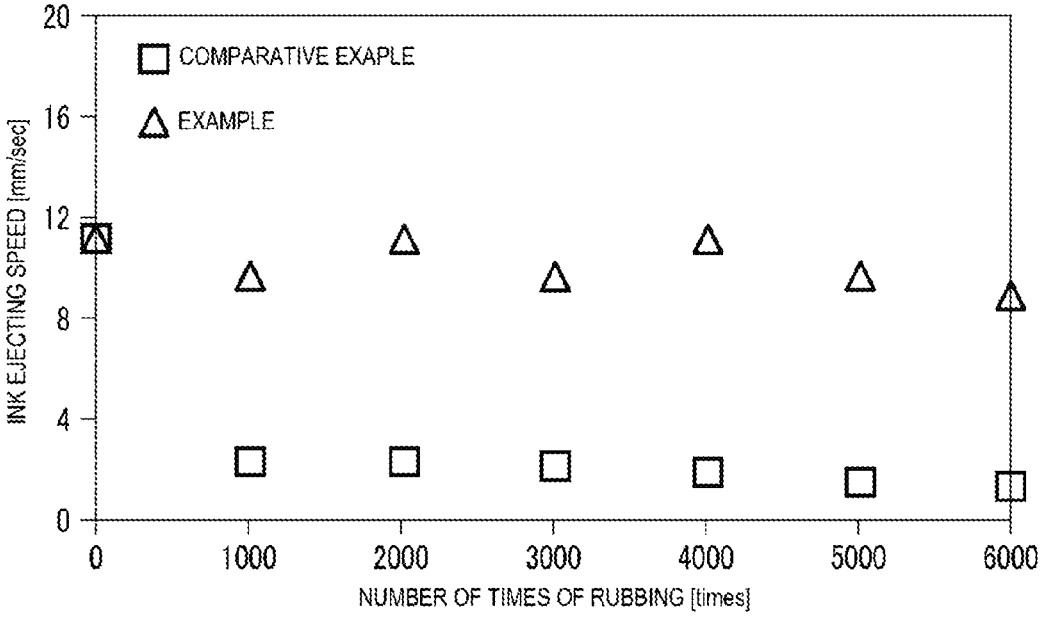
FIG. 13 depicts relationship between the number of times of rubbing and the speed when the nozzle plate ejects ink, obtained for a nozzle plate according to the embodiment and the comparative example.

FIG. 13 shows the relationship between the number of times of rubbing with the wiping blade and the speed at which the nozzle plate ejects ink, obtained for the nozzle plate according to the embodiment and the comparative example. In FIG. 13, the horizontal axis represents the number of times of rubbing by the wiping blade, and the vertical axis represents the speed at which the nozzle plate ejects ink.

As depicted in FIG. 13, in the nozzle plate of the comparative example, the ink repellency deteriorated after rubbing with the wiping blade less than 1000 times. In the nozzle plate of the example, deterioration of the ink repellency was suppressed even after rubbing the nozzle plate with the wiping blade as many as 6000 times.

As described above, in the inkjet head according to the embodiment, even when the recording medium facing surface of the nozzle plate was rubbed with the wiping blade, deterioration of the ink repellency was small.

While certain embodiments have been described, these embodiments have been presented by way of example only, and are not intended to limit the scope of the inventions. Indeed, the novel embodiments described herein may be embodied in a variety of other forms. Furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An inkjet head, comprising:

a nozzle plate substrate having a nozzle through which ink is ejected toward a recording medium; and an oil repellent layer on a surface of the nozzle plate substrate, the surface facing the recording medium, wherein the oil repellent layer comprises a fluorine-based compound in which neighboring molecules are cross-linked in a direction parallel to the surface, and cross-links of the neighboring molecules are resistant to structural change when subjected to rubbing by an ink wiping blade.

2. The inkjet head according to claim 1, wherein the oil repellent layer has a structure in which a change in a peak frequency showing maximum intensity in a frequency band of 0.7 to 1.4 THz in a reflection spectrum obtained by a terahertz time domain spectroscopy method is 0.2 THz or less before and after the rubbing.

3. The inkjet head according to claim 1, wherein the fluorine-based compound has a first end and a second end, the first end comprising a bonding group bonded to the nozzle plate substrate, the second end comprising a perfluoroalkyl group, and the bonding group being bonded to a bonding group of a neighboring fluorine compound bonded to the nozzle plate substrate.

4. The inkjet head according to claim 3, wherein the nozzle plate substrate includes a functional group on a surface thereof, the functional group being selected from a hydroxyl group, an ester bonding group, an amino group, and a thiol group, and the bonding group comprises a reactive functional group selected from an epoxy group, an amino group, a methacryl group, a vinyl group, and a mercapto group.

5. The inkjet head according to claim 3, wherein the fluorine-based compound further has a spacer linking group linking the first and second ends.

6. The inkjet head according to claim 5, wherein the perfluoroalkyl group at the second end is $C_3F_7$, and the spacer linking group is —(OCF2CF2CF2)$_{24}$-O—(CF2)$_2$-.

7. The inkjet head according to claim 5, wherein the perfluoroalkyl group at the second end is $C_3F_7$, and the spacer linking group is —(OCF2CF2CF2)$_p$-O—(CF2)$_2$-, p being a value from 1 to 50.

8. The inkjet head according to claim 1, wherein the fluorine-based compound is bonded to a surface of the nozzle plate substrate by a siloxane linkage.

9. The inkjet head according to claim 1, wherein the nozzle plate substrate is made of resin.

10. An inkjet printer, comprising:

a nozzle plate substrate having a nozzle through which ink is ejected toward a recording medium;

an oil repellent layer on a surface of the nozzle plate substrate, the surface facing the recording medium;

a medium holding mechanism that faces the nozzle plate substrate and holds the recording medium; and a wiping blade rubs the surface of the nozzle plate substrate, wherein the oil repellent layer comprises a fluorine-based compound in which neighboring molecules are cross-linked in a direction parallel to the surface, and cross-links of the neighboring molecules are resistant to structural change when subjected to rubbing by an ink wiping blade.

11. The inkjet printer according to claim 10, wherein the oil repellent layer has a structure in which a change in a peak frequency showing maximum intensity in a frequency band of 0.7 to 1.4 THz in a reflection spectrum obtained by a terahertz time domain spectroscopy method is 0.2 THz or less before and after the rubbing.

12. The inkjet printer according to claim 10, wherein the fluorine-based compound has a first end and a second end, the first end comprising a bonding group bonded to the nozzle plate substrate, the second end comprising a perfluoroalkyl group, and the bonding group being bonded to a bonding group of a neighboring fluorine compound bonded to the nozzle plate substrate.

13. The inkjet printer according to claim 12, wherein the nozzle plate substrate includes a functional group on a surface thereof, the functional group being selected from a hydroxyl group, an ester bonding group, an amino group, and a thiol group, and the bonding group comprises a reactive functional group selected from an epoxy group, an amino group, a methacryl group, a vinyl group, and a mercapto group.

14. The inkjet printer according to claim 12, wherein the fluorine-based compound further has a spacer linking group linking the first and second ends.

15. The inkjet printer according to claim 14, wherein the perfluoroalkyl group at the second end is C3F7, and the spacer linking group is —(OCF2CF2CF2)$_{24}$—O—(CF2)$_{2-}$.

16. The inkjet printer according to claim 14, wherein the perfluoroalkyl group at the second end is C3F7, and the spacer linking group is —(OCF2CF2CF2)$_{p}$—O—(CF2)$_{2-}$, p being a value from 1 to 50.

17. The inkjet printer according to claim 10, wherein the fluorine-based compound is bonded to a surface of the nozzle plate substrate by a siloxane linkage.

18. The inkjet printer according to claim 10, wherein the nozzle plate substrate is made of resin.

* * * * *